US006964599B2

(12) United States Patent
Incera et al.

(10) Patent No.: US 6,964,599 B2
(45) Date of Patent: Nov. 15, 2005

(54) METHOD AND APPARATUS FOR HOLDING OR MOUNTING AN OBJECT

(75) Inventors: Alex Incera, Pomfret, CT (US); Jeff Murray, Ellington, CT (US); Robert Shanbaum, Manchester, CT (US)

(73) Assignee: Gerber Coburn Optical, Inc., South Windsor, CT (US)

( * ) Notice: Subject to any disclaimer, the term of this patent is extended or adjusted under 35 U.S.C. 154(b) by 55 days.

(21) Appl. No.: 10/412,480

(22) Filed: Apr. 11, 2003

(65) Prior Publication Data

US 2004/0110452 A1 Jun. 10, 2004

Related U.S. Application Data

(63) Continuation-in-part of application No. 10/310,117, filed on Dec. 4, 2002, now Pat. No. 6,863,602.

(51) Int. Cl.[7] ..... B24B 1/00; B24B 29/02
(52) U.S. Cl. ..... 451/24; 451/42; 451/384
(58) Field of Search ..... 451/24, 54, 42, 451/240, 255, 256, 277, 289, 325, 364, 384, 451/385, 390, 460

(56) References Cited

U.S. PATENT DOCUMENTS

| | | | | |
|---|---|---|---|---|
| 4,669,226 A | | 6/1987 | Mandler | |
| 4,856,234 A | * | 8/1989 | Goins | 451/42 |
| 5,115,553 A | * | 5/1992 | Sealey et al. | 29/563 |
| 5,205,076 A | * | 4/1993 | Vernon et al. | 451/218 |
| 5,326,413 A | * | 7/1994 | Esemplare et al. | 156/154 |
| 5,357,716 A | * | 10/1994 | Kishida et al. | 451/390 |

(Continued)

FOREIGN PATENT DOCUMENTS

| | | | | |
|---|---|---|---|---|
| DE | 39 34 180 A | | 4/1990 | |
| EP | 0 169 931 A | | 2/1986 | |
| EP | 0 613 756 A | | 9/1994 | |
| JP | 2003115121 A | * | 4/2003 | G11B 7/09 |

*Primary Examiner*—David B. Thomas
(74) *Attorney, Agent, or Firm*—Morgan & Finnegan, LLP

(57) ABSTRACT

Disclosed herein is a holding device, which includes a volumetrically controllable material and a volume controller in operable communication with that material. The volume controller is configured to subject the material to a condition that causes a physical change in volume of the material without a change in mass of the material. The volumetric change causes the holding power. Further disclosed herein is a method for creating a lower than atmospheric pressure between a volumetrically controllable fixed mass material and a separate object. The method includes introducing to the material an increase condition calculated to volumetrically increase the material without changing the mass of the material. The separate object is then brought to contact the material following which a decrease condition calculated to volumetrically decrease the material without changing the mass of the material is introduced to the material. Further disclosed herein is a mounting device which includes an end effector including a material having at least a more pliable state and a less pliable state and wherein said states are reversible and repeatable. A pliability controller is configured to introduce to the material a condition calculated to change a state of the material between more pliable and less pliable. Further disclosed herein is a method for mounting an object which includes causing an end effector material to become more pliable and contacting the object with the material. The material is then transitioned to a less pliable condition.

46 Claims, 3 Drawing Sheets

U.S. PATENT DOCUMENTS 5,380,387 A * 1/1995 Salamon et al. ..... 156/154
5,474,489 A * 12/1995 Vernon ..... 451/42
5,794,498 A * 8/1998 Chaloux ..... 82/1.11
5,919,080 A * 7/1999 Savoie et al. ..... 451/5
6,045,438 A * 4/2000 Shay ..... 451/384
6,110,016 A * 8/2000 Coleman et al. ..... 451/42
6,568,990 B2 * 5/2003 Siders et al. ..... 451/5
6,586,499 B2 * 7/2003 Bonafini et al. ..... 532/168

* cited by examiner

METHOD AND APPARATUS FOR HOLDING OR MOUNTING AN OBJECT

CROSS-REFERENCE TO RELATED APPLICATIONS

This application is a continuation-in-part application of U.S. Ser. No. 10/310,117 filed Dec. 4, 2002 now U.S. Pat. No. 6,863,602, the entire contents of which is incorporated herein by reference.

BACKGROUND

In all operations where an object can be held, advances in accuracy, tolerances, precision, efficiency, etc. are desirable and can be achieved. Holding devices (or apparatus) and/or mounting apparatuses range from very simple to very complex but fundamentally have the same goals. One of those goals is to maintain an object in a position or a set of positions for reasons such as retention and to facilitate an operation being applied to the object.

In an age of decreasing time availability, higher production demands, and in some cases even increasing fragility of some objects to be held, holding technologies are a potential bottleneck. New holding and mounting devices are continually needed to meet demands.

SUMMARY

Disclosed herein is a holding device that includes a volumetrically controllable material and a volume controller in operable communication with that material. The volume controller is configured to subject the material to a condition that causes a physical change in volume of the material without a change in mass of the material. The volumetric change causes the holding power.

Disclosed herein is a holding device that includes a density controllable material and a density controller in operable communication with that material. The density controller is configured to subject the material to a condition that causes a physical change in density of the material without a change in mass of the material. The change in density causes the holding power.

Further disclosed herein is a method for creating a lower than atmospheric pressure between a volumetrically controllable fixed mass material and a separate object. The method includes introducing to the material an increase condition calculated to volumetrically increase the material without changing the mass of the material. The separate object is then brought to contact the material following which a decrease condition calculated to volumetrically decrease the material without changing the mass of the material is introduced to the material.

Further disclosed herein is a method for creating a lower than atmospheric pressure between a density-controllable fixed mass material and a separate object. The method includes introducing to the material a decrease condition calculated to decrease the density of the material without changing the mass of the material. The separate object is then brought to contact with the material following which an increase condition calculated to increase the density of the material without changing the mass of the material is introduced to the material.

Further disclosed herein is a method for holding an object which includes introducing to a volumetrically controllable material, a condition calculated to volumetrically change the material without changing the mass of the material, contacting the object with the material and introducing to the volumetrically controllable material another condition calculated to volumetrically change the material without changing the mass of the material. The holding is caused by the volumetric change.

Further disclosed herein is a mounting device, which includes an end effector, including a material having at least a more pliable state and a less pliable state and wherein the states are reversible and repeatable. A pliability controller is configured to introduce to the material a condition calculated to change a state of the material between more pliable and less pliable.

Further disclosed herein is a method for mounting an object, which includes causing an end effector material to become more pliable and contacting the object with the material. The material is then transitioned to a less pliable condition.

Further disclosed herein is a mounting apparatus, which includes a volume of material. A material controller is in operable communication with the material, the controller being configured to introduce a condition calculated to reversibly and repeatably change the volume of material between a less pliable state and a more pliable state.

BRIEF DESCRIPTION OF THE DRAWINGS

Referring now to the drawings wherein like elements are numbered alike in the several Figures.

DETAILED DESCRIPTION

Figure 1:
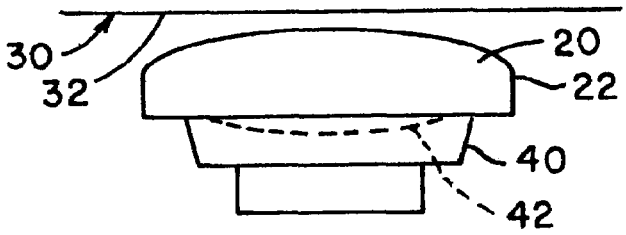
FIG. 1 is a cross-sectional schematic diagram of apparatus disclosed.

The methods and apparatuses ("devices" used interchangeably) described herein are well suited to hold a plethora of different objects. The hold and release functions are rapidly initiated, easily and readily reversible, easily and readily repeatable, and of low impact to an object being held or mounted. As used herein the term held implies that a load acting to remove an object from the holding device in the axial lateral or rotational direction will be resisted. As used herein the term mounted implies torsional and lateral resistance to movement as a result of some applied normal force, and no specific resistance to a load acting to separate the object from the mounting device in an axial direction; mounting does not necessarily indicate the lack of resistance to that axial load.

All of the embodiments herein rely upon a property of the formable material employed. The property of the material is that it can be rendered more pliable such that it can readily assume the shape of an object pressed against it. The material can then be rendered less pliable in that shape relatively easily. The material further exhibits reversibility and repeatability. Some of the embodiments herein further rely upon another property of the formable material, that property being controllable volumetric change without accompanying change in mass or a controllable change in density without accompanying change in mass. Such change if appropriately applied, as taught herein, is employable to cause a "holding" of an object to the formable material or a device including the formable material. The holding may be by means of a lower than atmospheric pressure created at an interface of the holding device and the object. In such instance the lower than atmospheric pressure is caused by the change in volume and/or density as noted. It will be appreciated that such can be augmented by evacuation in some applications if required without departing from the scope of the invention providing at least initial or additional holding is created by the change in the formable material. It will also be appreciated that the same property involving change in volume or density that can be capitalized upon to create a lower than ambient pressure if used in one way, can be employed in reverse to create a reversible interference fit to hold an object as well. More specifically, if the material is sized appropriately to fit in a recess when the density is greater or the volume is smaller and then a condition is introduced to increase volume or decrease density, the material will create an interference engagement in the recess.

With respect to volumetric and/or density change without accompanying mass change materials include: polymeric, monomeric, wax, magnetorheological, electrorheological, thermoactivated, metal alloy or other material, or a combination including at least one of the foregoing materials. One exemplary material is freebond™ (a wax compound) which is commercially available from Gerber Coburn Optical Inc., South Windsor, Conn. Further materials include: electrorheostatic materials, magnetorheostatic materials, and piezoelectric materials or a combination including at least one of the foregoing materials.

Conditions to cause the change desired include an increase condition and a decrease condition which comprise application of an electric potential, a magnetic field, a temperature change, a pressure change and other conditions that when paired with a particular material will cause a change between a more pliable state and a less pliable state as well as a volumetric change or density change, without change in mass. "Increase" and "decrease" are employed as condition names to distinguish between conditions when both are employed. "Increase" condition is used for increasing volume or increasing density and "decrease" condition is used for decreasing volume or decreasing density. This is for simplicity in reading claims; as one skilled in the art will understand, a decrease in density may accompany an increase in volume and vice versa.

Upon application of an appropriate condition, which will be applied by a controller (or a plurality of controllers) for any of the materials, the material will become more pliable. The controller may be a conduit for a temperature-adjustable fluid; an electrical conductor; a generator of a magnetic field; a pressure generator, etc. In the event the particular material is in a liquid state or otherwise a condition in which it will "run", it is desirable to confine the material in some way to avoid loss thereof. For example a cover, that is flexible and elastically stretchable during at least the more pliable condition of the material and during transition between more pliable and less pliable, may be placed over the material. Such a cover may be a plastic material such as thermoset materials, thermoplastic materials and elastomeric materials (e.g. vinyl). In the event the material utilized is self-confining, a cover is not needed.

To enhance understanding of the method and apparatus disclosed herein, reference is made to FIG. 1 wherein the schematically represented device is identified by numeral 10, the formable material is identified as numeral 10 and the object is identified as numeral 30. In the more pliable condition, following introduction thereto of a condition capable of rendering the specific material more pliable, the volume of the material will increase. Relatedly the density will decrease. This is important for reasons that will become apparent hereunder. While in the more pliable state, the material 20 is brought into contact with an object 30 to be held. The formable material 20 deforms to mimic the surface 32 features of the object 30. The material 20 is thus in a surface matched condition which promotes a sealing relationship with a surface of the object 30 because it is in direct contact therewith in substantially all locations.

When a condition is introduced to material 20 to cause material 20 to become less pliable, material 20 reduces in volume but not in mass creating the lower than ambient pressure discussed above, between material 20 and object 30. The change in volume is responsible for a dimensional change that creates the pressure drop. The material shrinks away from the object while still contacting the object at the periphery of the material. Because the volume of the space between the material and the object gets larger but no fluid can move into that space the pressure in the space must necessarily drop. The lower than atmospheric pressure effectively holds object 30. In order to enhance the pressure created, one embodiment will include a configuration of material 20 and support 40 that makes a central portion of material 20 effectively thicker than at a perimeter edge 22 of material 20. This is schematically illustrated with reference to broken line 42, which represents a concavity in support 40 into which material 20 is set. The center of the concavity is deeper than the periphery as is understood by one of ordinary skill in the art. This is helpful for the purpose stated because the volumetric change is proportional to the volume of the material utilized. Therefore, where the volume (thickness) of material is increased toward a center area, the volumetric reduction is increased toward that center area. In addition to enhancing the pressure differential, this embodiment also enhances contact pressure at the periphery of the material 20 to the object since the peripheral area does not dimensionally change as much as does the central area, causing increased contact pressure at the periphery. Such condition may help preserve the pressure differential for a longer period of time.

Figure 2A:
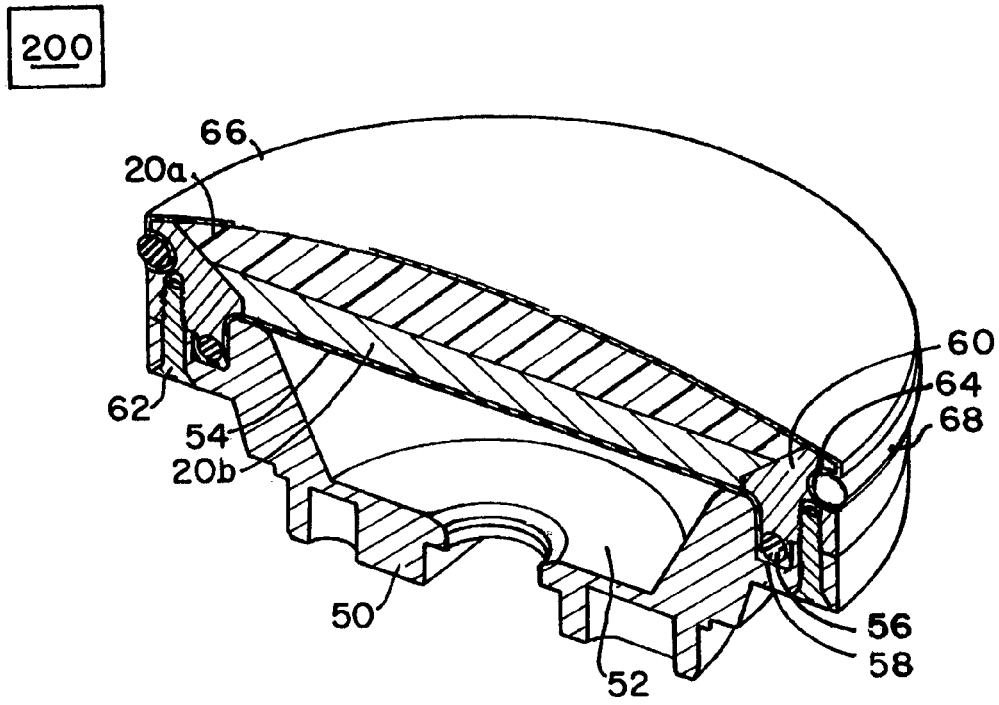
FIG. 2A is a top perspective cross-sectional view of another embodiment.
Figure 2B:
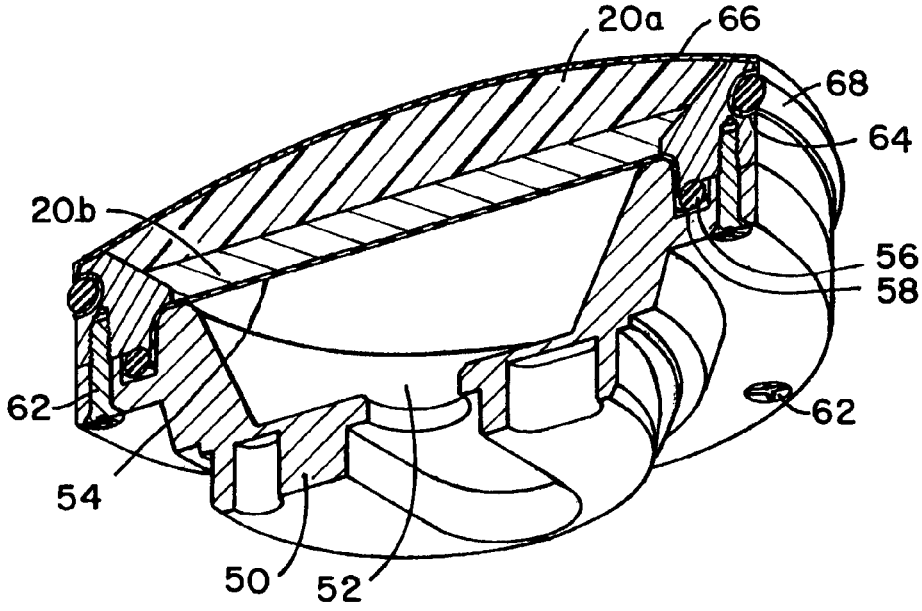
FIG. 2B is a bottom perspective cross-sectional view of the embodiment of FIG. 2A.

Referring to FIGS. 2A and 2B, another embodiment of the holding apparatus is disclosed. This particular embodiment, exemplary in nature, is built upon a base 50. Base 50 includes several features configured to enhance the operation of the apparatus (or device). An accumulator cavity 52 is located in a position to allow the material 20 to be urged thereinto. This makes the device easier to work with as the material does not need to move outwardly to accommodate a surface but can move into the base. A benefit of this approach is that it accommodates many differently shaped objects by allowing more or less material to be displaced to the cavity depending upon the shape of the object urged against the material. Material 20 is physically separated from the cavity by a resilient membrane 54. Membrane 54 deflects into cavity 52 when material 20 is urged into contact with an object to be held. Resilient membrane 54 also moves material back out of base 50 when it is not urged thereinto by an object. This tends to reset the holding device when next rendered more pliable.

Membrane 54 is retained in position by retainer 56, pressed into recess 58 while trapping a portion of membrane 54 as illustrated. Membrane 54 is further retained by retention ring 60, which is attached to base 50 by fasteners 62. It will be appreciated that retention ring 60 also includes a recess 64 at a circumferential periphery thereof. This recess is configured to accept a cover 66 and a spline 68 which may be an o-ring. Once spline 68 is installed, cover 66 is reliably retained and will hold material 20 in location. This is beneficial if material 20 happens to be one that in the more pliable state will run.

In this embodiment, material 20 is a bifurcated material. Portion 20*a* is wax based while portion 20*b* is an alloy. This has proven beneficial in that it provides accommodation of even more steeply shaped objects while still providing a stiff base structure. In addition, alloy heats quickly and helps transfer heat to the wax to render it more pliable more quickly. It should be noted that the wax portion and the alloy portion do not mix due to the vastly different specific gravities of the compounds. Even if the materials do become discontinuous due to mechanical interferences related to use, they will easily and rapidly separate. The alloy portion 20*b* always settles below the wax portion 20*a*. It is important to note that wax and alloy is but one example of the apparatus described herein with this property. Other combinations of materials can also be used with the same result. Other results may also be desirable in some situations, keeping in mind the ultimate purpose of the device as stated hereinabove.

Figure 3A:
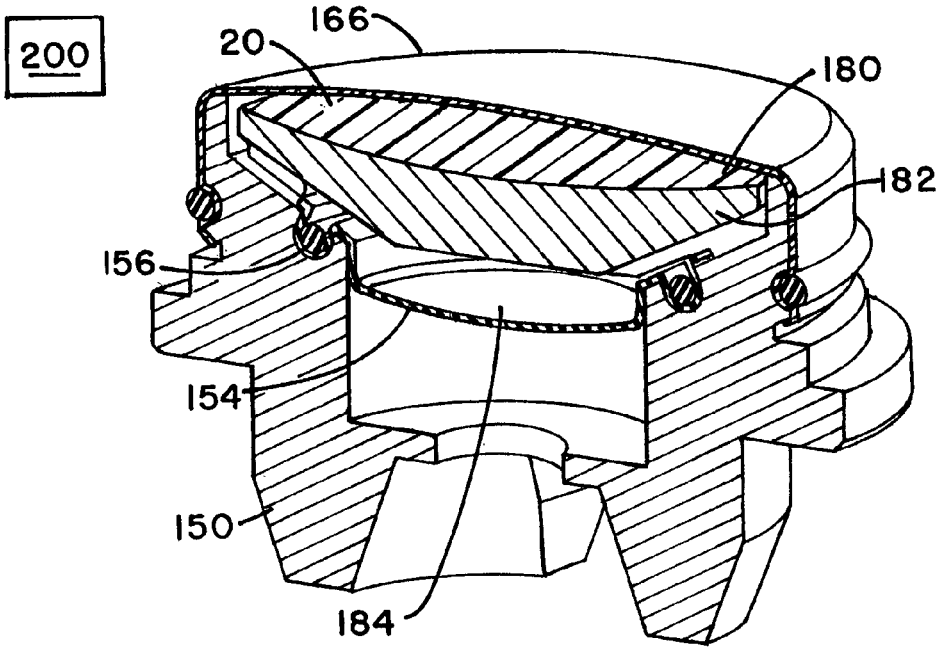
FIG. 3A is a third top perspective cross-sectional view of another embodiment.
Figure 3B:
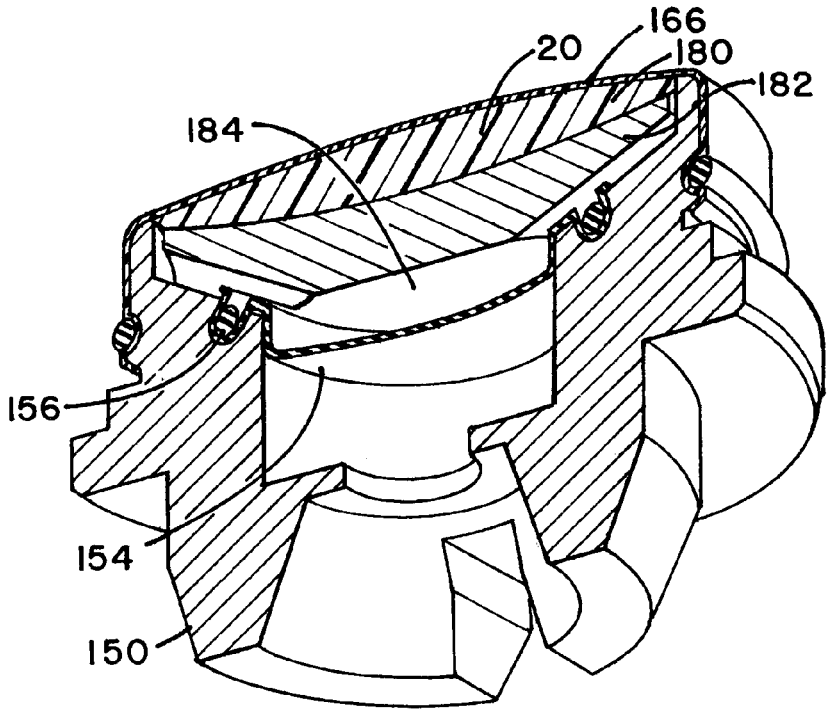
FIG. 3B is a bottom perspective cross-sectional view of the embodiment of FIG. 3A.

Referring now to FIGS. 3A and 3B, another embodiment of the apparatus is illustrated. A base 150 is illustrated with an accumulator cavity 152. A membrane 154, retainer 156 and cover 166 are also provided and are similar to the prior embodiment. It will be appreciated that although the components are not identical to the foregoing embodiment they are identifiable therewith and will be understood by one of ordinary skill in the art. Distinct form the prior embodiments, is channel block 180 which is received in base 150 and provides flow channels 182 for material 20. Material 20 is disposed between cover 166 and channel block 180 as well as being within flow channels 182 and in reservoir 184.

Upon application of a condition to render the material 20 more pliable and a compressive force applied to cover 166, material 20 will flow through flow channels 182 and deflect resilient membrane 154 similar to the foregoing embodiments and with similar benefits. Membrane 154 also helps to reset the device upon becoming more pliable as it did in the foregoing embodiment.

In each of the foregoing embodiments a controller 200 (or more controllers) will be provided. The controller is in operable communication with material 20 and adapted to introduce a condition to material 20 to transition that material between (in both directions) a less pliable state and a more pliable state. The condition required will depend upon the composition of the material 20.

Figure 4:
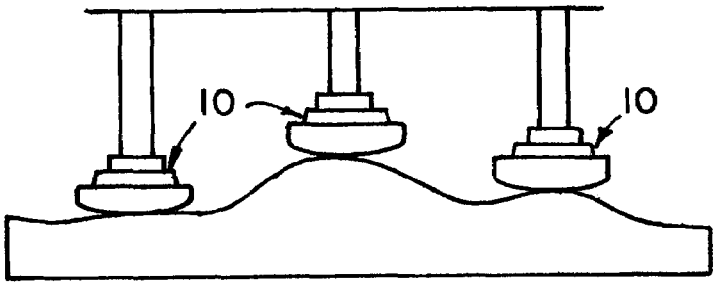
FIG. 4 is a schematic illustration of multiple holding devices used for one object.

It will be appreciated that one or more of the devices described may be employed together. For example, a small object (e.g., an ophthalmic lens, a watch case, etc.) may be held with one of these devices whereas a large object (e.g., a large pane of glass, stone slab, etc.) might be held with a plurality of these devices. It is also notable that the devices need not be in a single plane, rather they may be disposed on individual actuators and may hold objects of non-planar configurations as shown for example in FIG. 4.

Figure 5:
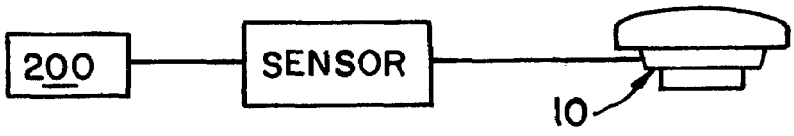
FIG. 5 is a schematic diagram of a holding device with a sensor to determine holding power.

In addition, a sensor illustrated schematically in FIG. 5, may be operatively associated with the device 10 to sense the holding power of the device. This may be by sensing differential pressure out the interface of the device and object.

As will be clear from the foregoing, the method for holding an object comprises introducing to a material a condition calculated to render the material more pliable; urging an object against the material to deform the same; and introducing a condition calculated to render the material less pliable. When the immediate holding job is complete the process is repeatable.

In another aspect of the apparatus and method disclosed herein, there are mounting operations that require no holding characteristics (as defined in this specification) but benefit from a matched surface structure between the mounting material and the object mounted. The concept disclosed hereinabove is useful for such mounting operations. This is particularly true in those cases where the mounting device contacts the object from two opposing surfaces and some amount of normal force is applied. In this type of application, volumetric change or change in density is not important. In this type of application, the only required attributes of the material are that it can be made more pliable and less pliable rapidly, reversibly, repeatably and easily, and that the mounting device provides resistance to torque and lateral forces applied to the mounted object. This can be accomplished by employing materials including polymeric, monomeric, wax, magnetorheological, electrorheological, thermoactivated, metal alloy or other material, or a combination including at least one of the foregoing materials. One exemplary material is freebond™ (a wax compound), which is commercially available from Gerber Coburn Optical Inc., South Windsor, Conn. Further materials include electrorheostatic materials, magnetorheostatic materials, and piezoelectric materials or a combination including at least one of the foregoing materials. The purpose for such property is of course to allow the material to assume the shape of the object surface and then be made less pliable in that shape.

Figure 6:
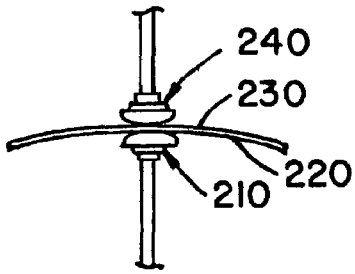
FIG. 6 is a schematic view of a mounting device.

Referring to FIG. 6, one embodiment of this concept is illustrated. The device is illustrated as 210 because it is very similar to the holding device described above but distinct in that it employs a material 220 that is transitionable between a more pliable state and a less pliable state but that does not necessarily change volume or density. Any material having appropriate properties may be employed including electrorheological materials, magnetorheological materials, thermoactivated materials, etc. which do not necessarily create holding power. It is also notable that some mounting devices use relatively small end effectors (in lateral dimension, e.g. diameter). Therefore, even where some of the materials discussed above as creating holding are used, significant holding would not be generated in the smaller mounting devices. In larger mounting devices, holding power might well be generated but as noted is not the object in the mounting device. The closely matched surface feature of the object 230 and the material 220 provides the desired mounting capability. In one embodiment, such device is useful for finishing lenses such as ophthalmic lenses.

A second end effector 240 is employed to retain the object in position. The second end effector may be of any material. In one embodiment, effector 240 is also constructed as is device 210 and functions similarly.

It should also be noted that a plurality of controllers may also be employed if desired.

It should be appreciated that two of the holding devices can be positioned against each other to create a torque limited coupling while providing an easy and quick reset operation.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed is:

1. A holding device comprising:

a holding device;

a volumetrically controllable material;

wherein the material is disposed in the entire holding area of the holding device, creating an uninterrupted, formable contact surface; and a volume controller in operable communication with the material, the volume controller subjecting the material to a condition causing a physical change in volume of the material without a change in mass of the material, the holding being caused by the volumetric change.

2. A holding device as claimed in claim 1 wherein said volumetric change is reversible and repeatable.

3. A holding device as claimed in claim 1 wherein the holding is caused by a reduction in volume of the material.

4. A holding device as claimed in claim 1 wherein the holding is caused by an increase in volume.

5. A holding device as claimed in claim 1 wherein said holding is caused without separate evacuation of fluid.

6. A holding device as claimed in claim 1 wherein said device further includes a flexible material disposed at said controllable material.

7. A holding device as claimed in claim 1 wherein said controllable material is thermally controllable.

8. A holding device as claimed in claim 1 wherein said controllable material is electrically controllable.

9. A holding device as claimed in claim 1 wherein said holding is by reversible interference fit.

10. A holding device as claimed in claim 1 wherein said controllable material is magnetically controllable.

11. A holding device as claimed in claim 1 wherein said controllable material is pneumatically controllable.

12. A holding device as claimed in claim 1 wherein said controllable material is pressure controllable.

13. A holding device as claimed in claim 12 wherein said material increases volumetrically under pressure.

14. A holding device as claimed in claim 12 wherein said material decreases volumetrically under evacuation.

15. A holding device as claimed in claim 12 wherein said material increases volumetrically under evacuation.

16. A holding device as claimed in claim 12 wherein said material decreases volumetrically under pressure.

17. A holding device as claimed in claim 1 wherein said material is a polymeric material, monomeric material, wax material, one of an electrorheological material, a magnetorheological material, thermoactivated material, metal alloy material and combinations including at least one of the foregoing materials.

18. A holding device as claimed in claim 1 wherein said material is a magnetorheostatic material, electrorheostatic material, piezoelectric material and combinations including at least one of the foregoing materials.

19. A holding device as claimed in claim 1 wherein said change in volume of said material without a change in mass of said material enhances an evacuated lower than ambient pressure condition.

20. A holding device as claimed in claim 1 wherein said change in volume of said material without a change in mass of said material lower than ambient pressure condition is augmented by evacuation.

21. An apparatus comprising a plurality of the holding devices claimed in claim 1.

22. A holding device comprising:

a holding device;

a density controllable material wherein the material is disposed in an entire holding area of the holding device, creating an uninterrupted, formable contact surface; and a density controller in operable communication with said material, said density controller subjecting said material to a condition causing a physical change in density of said material without a change in mass of said material, said holding being caused by said density change.

23. A method for creating a lower than atmospheric pressure between a volumetrically controllable fixed mass material and a separate object comprising:

introducing a holding device;

introducing to the material a decrease condition calculated to volumetrically decrease said material without changing the mass of said material;

contacting said separate material with said controllable material;

introducing to said controllable material a increase condition calculated to volumetrically increase said material without changing the mass of said material.

wherein the material is disposed in an entire holding area of the holding device, creating an uninterrupted, formable contact surface.

24. A method for creating a lower than atmospheric pressure between a volumetrically controllable fixed mass material and a separate object as claimed in claim 23 wherein the controllable material is one of a polymeric material, monomeric material, wax material, an electrorheological material, a magnetorheological material, a thermoactivated material, metal alloy material and combinations including at least one of the foregoing materials.

25. A method for creating a lower than atmospheric pressure between a volumetrically controllable fixed mass material and a separate object as claimed in claim 23 wherein the controllable material is one of a magnetorheostatic material, electrorheostatic material, piezoelectric material and combinations including at least one of the foregoing materials.

26. A method for creating a lower than atmospheric pressure between a volumetrically controllable fixed mass material and a separate object as claimed in claim 23 wherein introducing the increase condition comprises heating.

27. A method for creating a lower than atmospheric pressure between a volumetrically controllable fixed mass material and a separate object as claimed in claim 23 wherein introducing the decrease condition comprises cooling.

28. A method for creating a lower than atmospheric pressure between a volumetrically controllable fixed mass material and a separate object as claimed in claim 23 wherein the introducing for increase condition and for decrease condition are a change in electrical potential introduced, a change in magnetic field introduced, a change in pressure introduced and combinations including at least one of the foregoing.

29. A method for holding an object comprising:

introducing a holding device;

introducing to a volumetrically controllable material, a condition calculated to volumetrically change the material without changing the mass of the material;

wherein the material is disposed in the entire holding area of the holding device, creating an uninterrupted, formable contact surface;

contacting the object with the material;

introducing to the volumetrically controllable material another condition calculated to volumetrically change the material without changing the mass of the material; and holding the object wherein the holding is caused by the volumetric change.

30. A method for creating a lower than atmospheric pressure between a density controllable fixed mass material and a separate object comprising:

introducing a holding device;

introducing to the material a decrease condition calculated to decrease density of said material without changing the mass of said material;

contacting said separate material with said controllable material;

introducing to said controllable material an increase condition calculated to increase density of said material without changing the mass of said material and;

wherein the material is disposed in the entire holding area of the holding device, creating an uninterrupted, formable contact surface.

31. A mounting device comprising:

a mounting apparatus;

an end effector including a material having at least a more pliable state and a less pliable state and wherein said states are reversible and repeatable wherein the material is disposed in the entire holding area of the mounting apparatus, creating an uninterrupted, formable contact surface; and a pliability controller configured to introduce to said material a condition calculated to change a state of said material between more pliable and less pliable.

32. A mounting device as claimed in claim 31 wherein said mounting device further includes a second end effector.

33. A mounting device as claimed in claim 32 wherein said second end effector also includes a material having at least a more pliable state and a less pliable state.

34. A mounting device as claimed in claim 32 wherein said material is responsive to said pliability controller.

35. A mounting device as claimed in claim 32 wherein said material is responsive to a different pliability controller.

36. A mounting device as claimed in claim 31 wherein said material further exhibits a change in volume without a change in mass when changing between the more pliable and less pliable states.

37. A mounting device as claimed in claim 31 wherein said material further exhibits a change in density without a change in mass when changing between the more pliable and less pliable states.

38. A mounting device as claimed in claim 31 wherein said material is one of a polymeric material, monomeric material, wax material, one of an electrorheological material, a magnetorheological material, thermoactivated material, metal alloy material and combinations including at least one of the foregoing materials.

39. A mounting device as claimed in claim 31 wherein said material is one of a magnetorheostatic material, electrorheostatic material, piezoelectric material and combinations including at least one of the foregoing materials.

40. A method for mounting an object comprising:

introducing a mounting apparatus;

introducing an end effector material;

causing the end effector material to become more pliable and wherein the material is disposed in the entire holding area of the mounting apparatus, creating an uninterrupted, formable contact surface;

contacting said object with said material;

causing said material to become less pliable.

41. A method for mounting an object as claimed in claim 40 wherein said method further includes causing another end effector, of the same material or a different material that is capable of assuming a more pliable and less pliable state, to contact said object when in a more pliable state; and causing said another end effector material to become less pliable.

42. A method for mounting an object as claimed in claim 40 wherein said material further exhibits a change in volume without a change in mass when changing between the more pliable and less pliable states.

43. A method for mounting an object as claimed in claim 41 wherein said another end effector material further exhibits a change in volume without a change in mass when changing between the more pliable and less pliable states.

44. A mounting apparatus comprising:

a mounting apparatus;

a volume of material;

wherein the material is disposed in the entire holding area of the mounting apparatus, creating an uninterrupted, formable contact surface; and a material controller in operable communication with the material, the controller configured to introduce a condition calculated to reversibly, repeatably change the volume of material between a less pliable state and a more pliable state.

45. A mounting apparatus as claimed in claim 44 further including two controllers.

46. A torque limited coupling comprising:

a first holding device as claimed in claim 1;

a second holding device as claimed in claim 1; said first and second holding devices being positioned in opposed relationship so as to be held together.

* * * * *